United States Patent [19]

Schoen

[11] Patent Number: 4,898,627

[45] Date of Patent: Feb. 6, 1990

[54] ULTRA-RAPID ANNEALING OF NONORIENTED ELECTRICAL STEEL

[75] Inventor: Jerry W. Schoen, Middletown, Ohio

[73] Assignee: Armco Advanced Materials Corporation, Lyndora, Pa.

[21] Appl. No.: 173,695

[22] Filed: Mar. 25, 1988

[51] Int. Cl.[4] ..... H01F 1/04

[52] U.S. Cl. ..... 148/111; 148/112; 148/122

[58] Field of Search ..... 148/111, 112, 113, 122

[56] References Cited

U.S. PATENT DOCUMENTS

| | | | |
|---|---|---|---|
| 3,144,364 | 8/1964 | Robinson et al. | 148/113 |
| 3,948,691 | 4/1976 | Matsushita et al. | 148/112 |
| 4,469,533 | 9/1984 | Inokuti et al. | 148/111 |
| 4,576,658 | 3/1986 | Inokuti et al. | 148/111 |

FOREIGN PATENT DOCUMENTS

| | | |
|---|---|---|
| 102507 | 5/1987 | Japan . |
| 102506 | 5/1988 | Japan . |

OTHER PUBLICATIONS

Szymura et al., "The Effect of Heating Rate During Primary Recrystallization", *Arch. Hutn.,* 1978, 23(1), pp. 29–33.

"Improved Sheet Steels by Rapid Annealing", *Metal Progress,* Apr. 1987, S. L. Semiatin et al., pp. 43–50.

*Primary Examiner*—John P. Sheehan

*Attorney, Agent, or Firm*—L. A. Fillnow; R. J. Bunyard; R. H. Johnson

[57] ABSTRACT

Ultra-rapid annealing of nonoriented electrical steel is conducted at a rate above 100° C. per second on prior to or as part of the strip decarburization and/or annealing process to provide an improved texture and, thereby, improved permeability and reduced core loss. During the ultra-rapid heating of cold-rolled strip, the recrystallization texture is enhanced by more preferential nucleation of {100}<uvw> and {110}<uvw> oriented crystals and reduced formation of {111}<uvw> oriented crystals. The preferred practice has a heating rate above 262° C. per second to a peak temperature between 750° C. and 1150° C. and held at temperature for 0 to 5 minutes.

13 Claims, 4 Drawing Sheets

ULTRA-RAPID ANNEALING OF NONORIENTED ELECTRICAL STEEL

BACKGROUND OF THE INVENTION

The present invention relates to a method of manufacturing nonoriented electrical steel by providing an ultra-rapid anneal to improve the core loss and the magnetic permeability.

Nonoriented electrical steels are used as the core materials in a wide variety of electrical machinery and devices, such as motors and transformers. In these applications, both low core loss and high magnetic permeability in both the sheet rolling and transverse directions are desired. The magnetic properties of nonoriented electrical steels are affected by volume resistivity, final thickness, grain size, purity and the crystallographic texture of the final product. Volume resistivity can be increased by raising the alloy content, typically using additions of silicon and aluminum. Reducing the final thickness is an effective means of reducing the core loss of restricting eddy current component of core loss; however, reduced thickness causes problems during strip production and fabrication of the electrical steel laminations in terms of productivity and quality. Achieving an appropriately large grain size is desired to provide minimal hysteresis loss. Purity can have a significant effect on core loss since dispersed inclusions and precipitates can inhibit grain growth during annealing, preventing the formation of an appropriately large grain size and orientation and, thereby, producing higher core loss and lower permeability, in the final product form. Also, inclusions will hinder domain wall movement during AC magnetization, further degrading the magnetic properties. As noted above, the crystallographic texture, that is, the distribution of orientations of the crystal grains comprising the electrical steel sheet, is very important in determining the core loss and, particularly, the magnetic permeability. The permeability increases with an increase in the {100} and {110} texture components as defined by Miller's indices since these are the directions of easiest magnetization. Conversely, the {111}-type texture components are less preferred because of their greater resistance to magnetization.

Nonoriented electrical steels may contain up to 6.5% silicon, up to 3% aluminum, carbon below 0.10% (which is decarburized to below 0.005% during processing to avoid magnetic aging) and balance iron with a small amount of impurities. Nonoriented electrical steels are distinguished by their alloy content, including those generally referred to as motor lamination steels contaning less than 0.5% silicon, low-silicon steels containing about 0.5% to 1.5% silicon, intermediate-silicon steels containing about 1.5 to 3.5% silicon, and high-silicon steels containinag more than 3.5% silicon. Additionally, these steels may have up to 3.0% aluminum in place of or in addition to silicon. Silicon and aluminum additions to iron increase the stability of ferrite; thereby, electrical steels having in excess of 2.5% silicon+aluminum are ferritic, that is, they undergo no austenite/ferrite phase transformation during heating or cooling. These additions also serve to increase volume resistivity, providing suppression of eddy currents during AC magnetizatin and lower core loss. Thereby, motors, generators and transformers fabricated from the steels are more efficient. These additions also improve the punching characteristics of the steel by increasing hardness. However, increasing the alloy content makes processing by the steelmaker more difficult because of the increased brittleness of the steel.

Nonoriented electrical steels are generally provided in two forms, commonly known as "fully-processed" and "semi-processed" steels. "Fully-processed" infers that the magnetic properties have been developed prior to fabrication of the sheet into laminations, that is, the carbon content has been reduced to less than 0.005% to prevent magnetic aging and the grain size and texture have been established. These grades do not require annealing after fabrication into laminations unless so desired to relieve fabrication stresses. Semi-processed infers that the product must be annealed by the customer to provide appropriate low carbon levels to avoid aging, to develop the proper grain size and texture, and/or to relieve fabrication stresses.

Nonoriented electrical steels differ from grain oriented electrical steels, the latter being processed to develop a highly directional (110)[001] orientation. Grain oriented electrical steels are produced by promoting the selective growth of a small percentage of grains having a (110)[001] orientation during a process known as secondary grain growth (or secondary recrystallization). The preferred growth of these grains results in a product with a large grain size and extremely directional magnetic properties with respect to the sheet rolling direction, making the product suitable only in applications where such directional properties are desired, such as in transformers. Nonoriented electrical steels are predominantly used in rotating devices, such as motors and generators, where more nearly uniform magnetic properties in both the sheet rolling and transverse directions are desired or where the high cost of grain oriented steels is not justified. As such, nonoriented electrical steels are processed to develop good magnetic properties, i.e., high permeability and low core loss, in both sheet directions; thereby, a product with a large proportion of {100} and {110} oriented grains is preferred. There are some specific and specialized applications within which nonoriented electrical steels are used where higher permeability and lower core loss along the sheet rolling direction are desired, such as in low value transformers where the more expensive grain oriented electrical steels cannot be justified.

DESCRIPTION OF THE PRIOR ART

U.S. Pat. No. 2,965,526 uses induction heating rates of 27° C. to 33° C. per second (50°-60° F. per second) between cold rolling stages and after the final cold reduction for recrystallization annealing in the manufacture of (110)[001] oriented electrical steel. In the recrystallization anneal of U.S. Pat. No. 2,965,526, the strip was rapidly heated to a soak temperature of 850° C. to 1050° C. (1560° F. to 1920° F.) and held for less than one minute to avoid grain growth. The rapid heating was believed to enable the steel strip to quickly pass through the temperature range within which crystal orientations were formed which were harmful to the process of secondary grain growth in a subsequent high temperature annealing process used in the manufacture of (110)[001] oriented electrical steels.

The controlled use of strip tension and rapid heating at up to 80° C. per second (145° F. per second) is disclosed in Japanese patent applications J62102-506A and J62102-507A which were published on May 13, 1987.

This work has primarily addressed the effect of tension on the magnetic properties parallel and transverse to the strip rolling direction. During annealing, the application of very low tension (less than 500 g/mm.) along the strip rolling direction was found to provide more uniform magnetic properties in both sheet directions; however, at these relatively slow heating rates, no clear effect of heating rate is evident.

The closest prior art known to the applicant is U.S. Pat. No. 3,948,691 which teaches that a nonoriented electrical steel, after cold rolling, is heated at 1.6° to 100° C. per second (2° F. to 180° F.) and annealed at from 600° C. to 1200° C. (1110° F. to 2190° F.) for a time period in excess of 10 seconds. The decarburization process is conducted on the hot rolled steel prior to cold rolling. The fastest heating rate employed in the examples is 12.8° C. per second (23° F. per second).

SUMMARY OF THE INVENTION

The present invention relates to the discovery that ultra-rapid heating during annealing at rates above 100° C. per second (180° F. per second) can be used to enhance the crystallographic texture of nonoriented electrical steels. The improved texture provides both lower core loss and high permeability. The ultra-rapid anneal is conducted after at least one stage of cold rolling and prior to decarburizing (if necessary) and final annealing. Alternatively, a nonoriented electrical steel strip made by direct strip casting may be ultra-rapidly annealed in either the as-cast condition or after an appropriate cold reduction. Further, it has been found that by adjusting the soak time that the magnetic properties can be modified to provide still better magnetic properties in the sheet rolling direction.

The ultra-rapid annealing step is conducted up to a peak temperature of from 750° C. to 1150° C. (1380° F. to 2100° F.), depending on the carbon content (the need for decarburization) and the desired final grain size.

It is a principal object of the present invention to reduce the core loss and increase the permeability of nonoriented electrical steels using an ultra-rapid anneal processing. Another object of the present invention is to improve productivity by increasing the heating rate during the final strip decarburization (if necessary) and annealing process. Another object of the present invention is to use the combination of ultra-rapid heating with selected peak temperatures to provide an enhanced texture. The above and other objects, features and advantages of the present invention will become apparent upon consideration of the detailed description and appended drawings.

DETAILED DESCRIPTION OF THE PREFERRED EMBODIMENT

Figure 1:
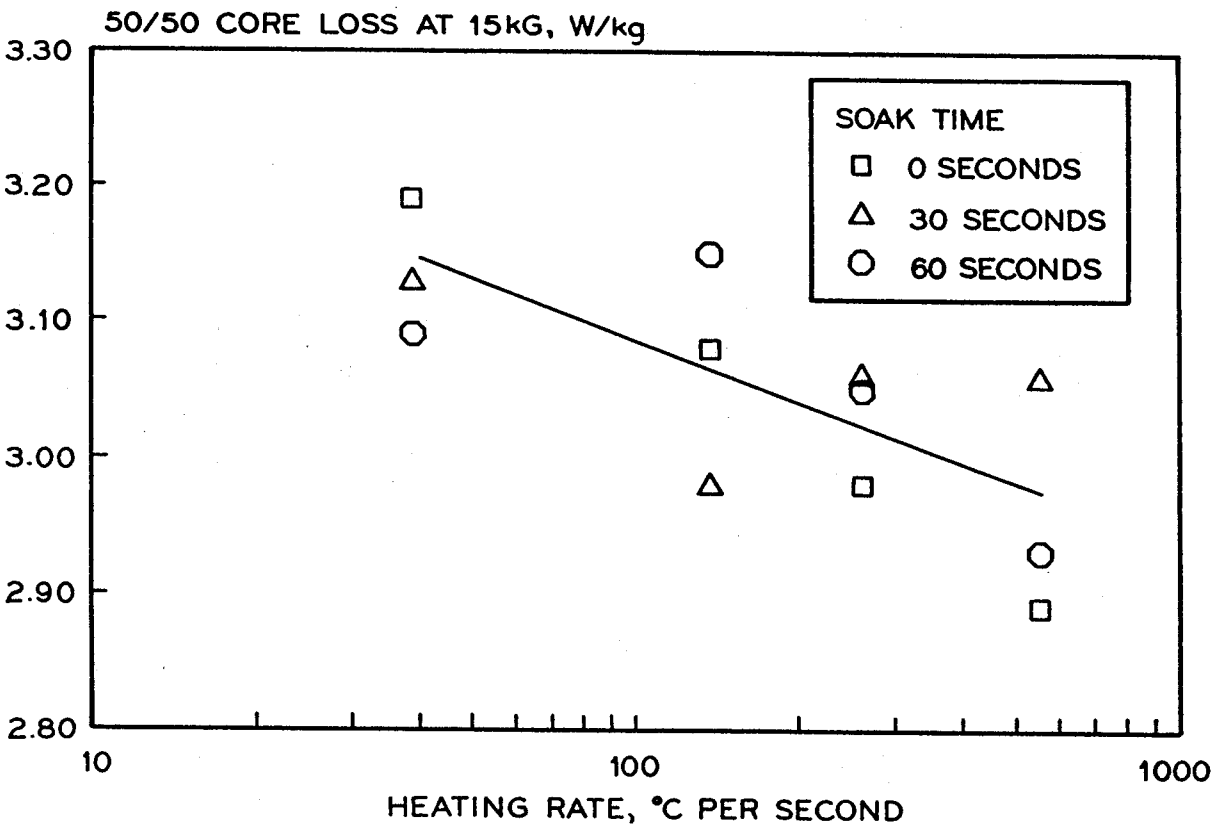
FIG. 1 shows the influenced of ultra-rapid annealing on 50/50-Grain core loss of nonoriented electrical steel at 15 kG for heating rates up to 555° C. per second (1000° F. per second)

In materials having very high magnetocrystalline anisotropy, such as iron and silicon-iron alloys commonly used as the magnetic core materials for motors, transformers and other electrical devices, the crystal orientation has a profound effect on the magnetic permeability and hysteresis loss (i.e., the ease of magnetization and efficiency during cyclical magnetization). Nonoriented electrical steels are used generally in rotating devices where more nearly uniform magnetic properties are desired in all directions within the sheet plane. In some applications, nonoriented steels are used where more directional magnetic properties may be desired and the additional cost of a (110)[001] oriented electrical steel sheet is not warranted. Thereby, the development of a sharper texture in the sheet rolling direction is desired. The sheet texture can be improved by composition control, particularly by controlling precipitate-forming elements such as oxygen, sulfur and nitrogen, and by proper thermomechanical processing. The present invention has found a way to improve the texture of nonoriented electrical steels, thereby providing both improved magnetic permeability and reduced core loss. Further, it has been found within the context of the present invention, that proper heat treatment enables the development of a product with better and more directional magnetic properties in the sheet rolling direction when desired. The present invention utilizes an ultra-rapid anneal wherein the cold-rolled sheet is heated to temperature at a rate exceeding 100° C. per second (180° F. per second) which provides a substantial improvement in the sheet texture and, thereby, improves the magnetic properties. When the nonoriented strip is subjected to the ultra-rapid anneal, the crystals having {100} and {110} orientations are better developed. Further, control of the soak time at temperature has been found to be effective for controlling the anisotropy, that is, the directionality, of the magnetic properties in the final sheet product. Heating rates above 133° C. per second (240° F. per second), preferably above 266° C. per second (480° F. per second), and more preferably above 550° C. per second (990° F. per second) will produce an excellent texture. The ultra-rapid anneal can be accomplished between cold rolling stages or after the completion of cold rolling as a replacement for an existing normalizing annealing treatment, integrated into a presently utilized conventional process annealing treatment as the heat-up portion of the anneal or integrated into the existing decarburization annealing cycle, if needed. The ultra-rapid anneal is conducted such that the cold-rolled strip is rapidly heated to a temperature above the recrystallization temperature nominally 675° C. (1250° F.), and preferably, to a temperature between 750° C. and 1150° C. (1380° F. and 2100° F.). The higher temperatures may be used to increase productivity and also promote the growth of crystal grains. If conducted as the heating portion of the decarburization anneal, the peak temperature is from 850° C. to 1150° C. preferably from 800° C. to 900° C. (1470° F. to 1650° F.) to improve the removal of carbon to a level below 0.005% and the decarburization anneal is at a temperature from 700° C. to 950° C. It is within the concept of the present invention that the strip can be processed by ultra-rapid annealing to temperatures as high as 1150° C. (2100° F.) and be cooled prior to decarburization either in tandem with or as a subsequent annealing process.

Figure 3:
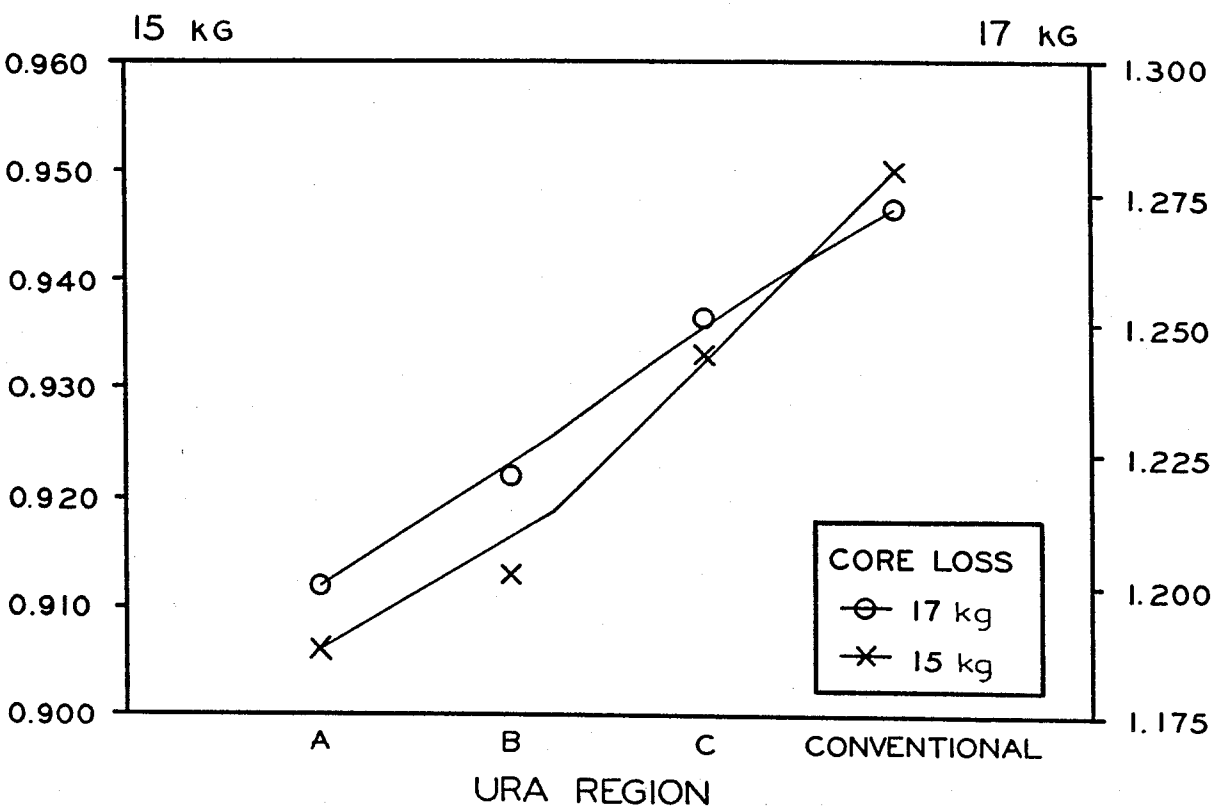
FIG. 3 shows the influence of soak time up to 60 seconds at 1035° C. (1895° F.) for nonoriented electrical steel subjected to an ultra-rapid anneal heating rates greater than 250° C. per second (450° F. per second) on 50/50-Grain, parallel grain and tranverse grain core loss of nonoriented electrical steel at 15 kG.
Figure 4:
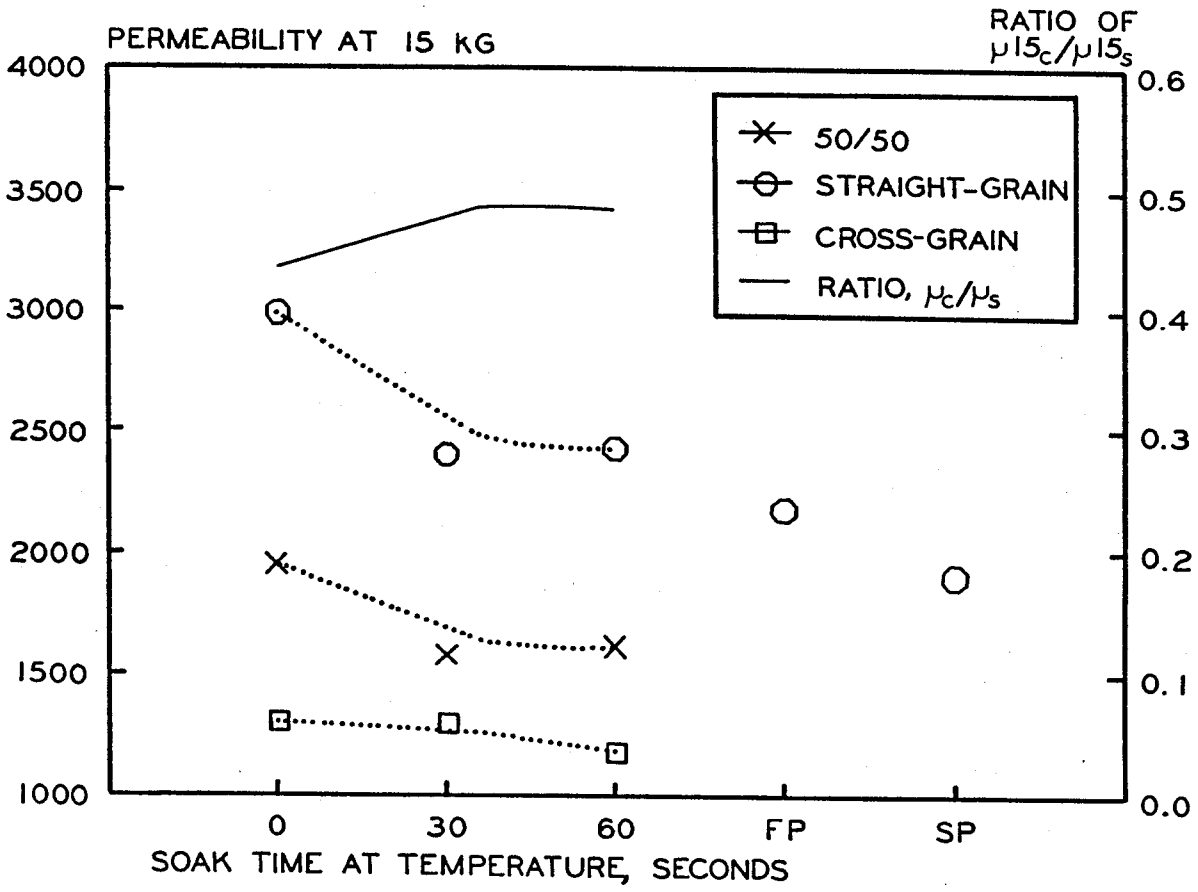
FIG. 4 shows the influence of soak time up to 60 seconds at 1035° C. (1895° F.) for nonoriented electrical steel subjected to an ultra-rapid anneal heating rates greater than 250° C. per second (450° F. per second) on 50/50-Grain, parallel grain and transverse grain permeability of nonoriented electrical steel at 15 kG.

The soak times utilized with ultra-rapid annealing are normally from zero to less than one minute at the peak temperature. The magnetic properties of nonoriented electrical steels are affected by a number of factors over and above the sheet texture, particularly, by the grain size. It has been found that proper control of the soak time at temperature is effective for controlling the directionality of the magnetic properties developed in the steels. As shown in FIGS. 3 and 4, specimens prepared using the practice of the present invention having been heated to 1035° C. (1895° F.) at heating rates exceeding 133° C. per second (240° F. per second) and soaked for different time periods at temperature have similar average magnetic properties as determined by the 50/50-Grain Epstein test method. However, evaluating the magnetic properties in the sheet rolling direction versus the sheet transverse direction shows that the soak time at temperature affected the directionality of the magnetic properties. Lower core loss and higher permeability can be obtained along the sheet rolling direction when the soak time is kept suitably brief, making the product more suited to applications where directional magnetic properties are desired. Extending the soak time is useful for providing more uniform properties in both sheet directions, making the product more suited to applications where uniform properties are sought. In both instances, ultra-rapid annealing provides lower core loss and higher permeability than conventional processing.

As indicated above, the starting material of the present invention is a material suitable for manufacture in a nonoriented electrical steel containing less than 6.5% silicon, less than 3% aluminum, less than 0.1% carbon and certain necessary additions such as phosphorus, manganese, antimony, tin, molybdenum or other elements as required by the particular process as well as certain undesirable elements such as sulfur, oxygen and nitrogen intrinsic to the steelmaking process used. These steels are produced by a number of routings using the usual steelmaking and ingot or continuous casting processes followed by hot rolling, annealing and cold rolling in one or more stages to final gauge. Strip casting, if commercialized, would also produce material which would benefit from the present invention when practiced on either the as-cast strip or after an appropriate cold reduction step.

It will be understood that the product of the present invention can be provided in a number of forms, including fully processed nonoriented electrical steel where the magnetic properties are fully developed or fully recrystallized semi-processed nonoriented electrical steel which may require annealing for decarburization, grain growth and/or removal of fabrication stresses by the end user. It will also be understood that the product of the present invention can be provided with an applied coating such as, but not limited to, the core plate coatings designated as C-3, C-4and C-5 in A.S.T.M. Specification A 677.

There are several methods to heat strip rapidly in the practice of the present invention; including, but not limited to, solenoidal induction heating, transverse flux induction heating, resistance heating, and directed energy heating such as by lasers, electron beam or plasma systems. Induction heating is especially suitable to the application of ultra-rapid annealing in high speed commercial applications because of the high power and energy efficiency available. Other heating methods employing immersion of the strip into a molten salt or metal bath are also capable of providing rapid heating.

It will be understood that the above embodiments do not limit the scope of the invention and the limits should be determined from the appended claims.

EXAMPLE I

Figure 2:
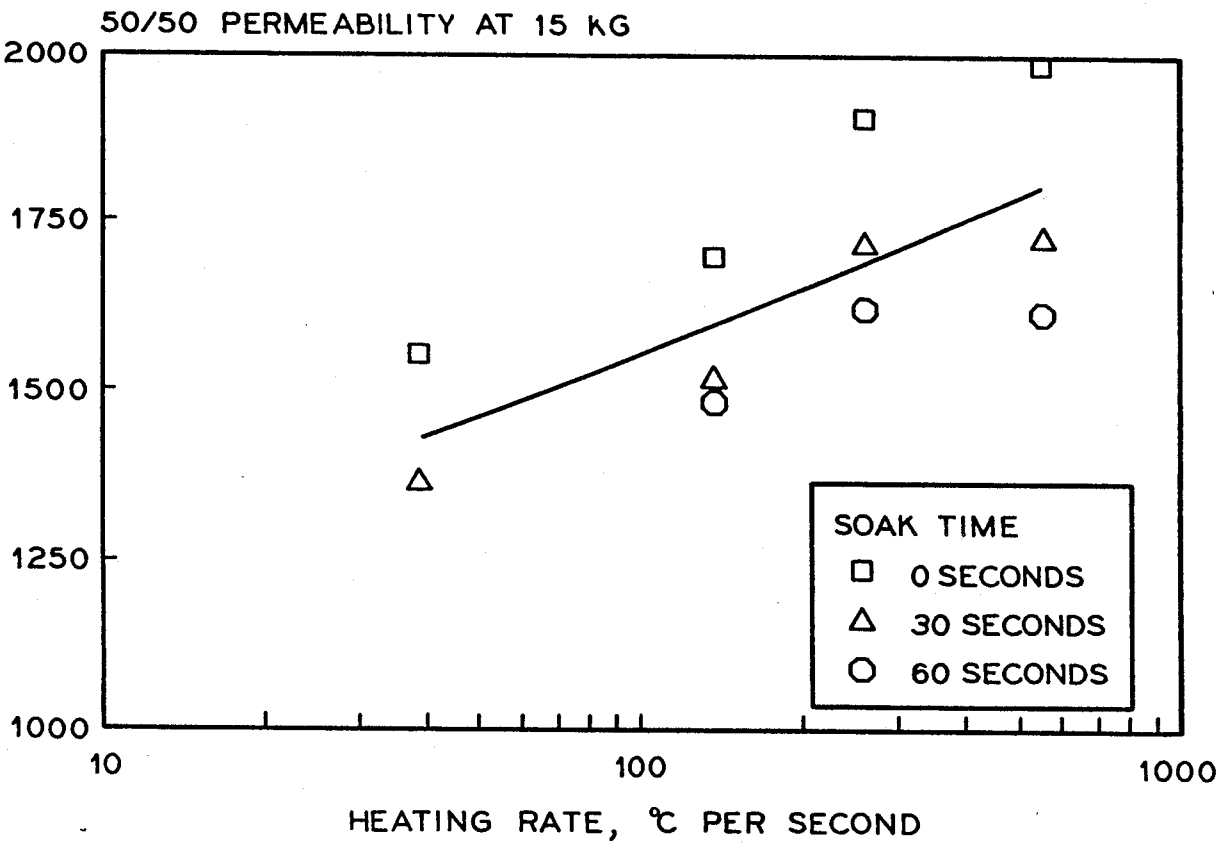
FIG. 2 shows the influence of ultra-rapid annealing on 50/50-Grain permeability of nonoriented electrical steel at 15 kG for heating rates up to 555° C. per second (1000° F. per second)

A sample sheet of 1.8 mm (0.07 inch) thick hot-rolled steel sheet of composition (by weight) 0.0044% C, 2.02% Si, 0.57% Al, 0.0042% N, 0.15% Mn, 0.0005% S and 0.006% P was subjected to hot band annealing at 1000° C. (1830° F.) for 1.5 minutes and cold-rolled to a thickness of 0.35 mm (0.014 inch). After cold rolling, the material was ultra-rapidly annealed by heating on a specially designed resistance heating apparatus at rates of 40° C. per second (72° F. per second), 138° C. per second (250° F. per second), 262° C. per second (472° F. per second), and 555° C. per second (1000° F. per second) to a peak temperature of 1038° C. (1900° F.) and held at temperature for a time period of from 0 to 60 seconds while maintained under less than 0.1 kg/mm$^2$ (142 lbs/inch$^2$) tension. During heating and cooling, the samples were maintained under a nonoxidizing atmosphere of 95% Ar-5% $H_2$. After annealing, the samples were sheared into Epstein strips and stress relief annealed at 800° C. (1472° F.) in an atmosphere of 95% nitrogen-5% hydrogen. The 50/50-Grain Epstein test was used to measure the core loss and permeability at a test induction of 15 kG in accordance with ASTM Specification A 677. The grain size was measured using ordinary optical metallographic methods. The resultant effect on the core loss and permeability are shown in Table I and FIGS. 1 and 2.

TABLE I 0.35 mm Thick Nonoriented Electrical Steel
50/50 Magnetic Properties Measured at 60 Hz. Core Loss Reported in W/kg. Test Density = 7.70 gm/cc. Grain Size Reported in um.

| | Ultra-Rapid Anneal | | | | | |
|---|---|---|---|---|---|---|
| Sample | Heating Rate (°C./sec) | Peak Temp (°C.) | Soak Time (sec) | P15/60 (W/kg) | μ15 | Grain Size (μm) |
| 1 | 40 | 1,038 | 0 | 3.19 | 1551 | 68 |
| 2 | 40 | 1,038 | 30 | 3.13 | 1364 | 95 |
| 3 | 40 | 1,038 | 60 | 3.09 | 1366 | 97 |
| 4* | 138 | 1,038 | 0 | 3.08 | 1697 | 57 |
| 5* | 138 | 1,038 | 3 | 2.98 | 1517 | 109 |
| 6* | 138 | 1,038 | 60 | 3.15 | 1483 | 104 |
| 7* | 138 | 1,038 | 64 | 3.16 | 1444 | 106 |
| 8* | 262 | 1,038 | 0 | 2.98 | 1906 | 59 |
| 9* | 262 | 1,038 | 30 | 3.06 | 1717 | 92 |
| 10* | 262 | 1,038 | 60 | 3.05 | 1620 | 95 |
| 11* | 555 | 1,038 | 0 | 2.89 | 1990 | 53 |
| 12* | 555 | 1,038 | 30 | 3.06 | 1441 | 102 |
| 13* | 555 | 1,038 | 60 | 2.93 | 1613 | 106 |

*Steels of the invention

The above results clearly show the benefit of ultra-rapid heating on the magnetic properties of nonoriented electrical steels as measured using the 50/50-Grain Epstein test. The samples from the above study were combined to provide composite specimens to determine the magnetic properties in the sheet rolling direction versus the sheet transverse direction. The results are shown in Table II and FIGS. 3 and 4.

Comparison samples A and B from the heat of Example I were processed by conventional methods used in the manufacture of nonoriented electrical steels. After cold rolling, sample A was annealed using a heating rate of 14° C. per second (25° F. per second) to 815° C. (1500° F.), held for 60 seconds at 815° C. in a 75% hydrogen-25% nitrogen atmosphere having a dew point of +32° C. (90° F.) after which the sample was again conventionally heated to 982° C. (1800° F.) and held at 982° C. for 60 seconds in a dry 75% hydrogen-25% nitrogen atmosphere. Sample B was made identically except that the cold rolled specimens were heated at 16° C. per second (30° F. per second) to 982° C. (1800° F.) and held at 982° C. for 60 seconds in a dry hydrogen-nitrogen atmosphere. After annealing was complete, the samples were sheared parallel to the rolling direction into Epstein strips and stress relief annealed at 800° C. (1472° F.) in an atmosphere of 95% nitrogen-5% hydrogen. Straight-grain core loss and permeability are shown in Table II and FIGS. 3 and 4 for comparison samples produced by the practice of the present invention.

TABLE II

| | | 0.35 mm Thick Nonoriented Electrical Steel | | | | | |
|---|---|---|---|---|---|---|---|
| | Soak | P15:60 Core Loss | | | μ15 Permeability | | |
| Sample | Time (sec) | 50/50 | Straight Grain | Cross Grain | 50/50 | Straight Grain | Cross Grain |
| (A) 50/50-Grain, Straight-Grain and Cross-Grain Magnetic Properties Measured at 60 Hz. Core Loss Reported in W/kg. Test Density = 7.70 gm/cc. | | | | | | | |
| 8 + 11 | 0 | 2.936 | 2.733 | 3.064 | 1948 | 2980 | 1298 |
| 9 + 12 | 30 | 3.050 | 2.881 | 3.086 | 1579 | 2390 | 1191 |
| 10 + 13 | 60 | 2.991 | 2.975 | 2.975 | 1617 | 2420 | 1171 |
| A | 60 | | 2.953 | | | 1904 | |
| B | 60 | | 2.887 | | | 2175 | |
| (B) Ratio of Cross Grain and Straight Grain Magnetic Properties | | | | | | | |
| 8 + 11 | 0 | | Pc/Ps = 1.12 | | | μc/μs = 0.435 | |
| 9 + 12 | 30 | | 1.07 | | | 0.498 | |
| 10 + 13 | 60 | | 1.00 | | | 0.483 | |

The above results clearly show the improvement in the magnetic properties of nonoriented electrical steels with the practice of the present invention compared to conventional processing. Also, the effect of soak time on the directionality of the core loss properties achieved using ultra-rapid heating is clear. As can be seen, all samples had similar 50/50 core loss; however, the magnetic properties along the rolling direction can be improved by proper selection of the soak time. Particularly, very low core loss and high permeability can be achieved along the sheet rolling direction by proper selection of ultra-rapid annealing conditions.

I claim:

1. A method for annealing nonoriented electrical steel strip which comprises:

a. heating said strip at a rate above 133° C. per second.

b. heating said strip to a peak temperature of from 750° C. to 1150° C., and c. soaking said strip for a period less than five minutes within said peak temperature range.

2. The method of claim 1 wherein said soaking period is less than one minute.

3. The method of claim 1 wherein said heating rate is above 262° C. per second.

4. The method of claim 1 wherein said heating rate is above 555° C. per second.

5. The method of claim 1 wherein said annealing method is a decarburizing anneal.

6. The method of claim 1, wherein said strip is cold rolled at least once before said annealing.

7. The method of claim 1 wherein said anneal is between stages of cold rolling.

8. The method of claim 5 wherein said peak temperature is from 850° C. to 1150° C. and said decarburizing anneal is at a temperature from 700° C. to 950° C.

9. The method of claim 8 including a strain relief anneal after said decarburizing anneal.

10. The method of claim 1 wherein said strip prior to said annealing contains, in weight %, less than 4% silicon, less than 0.1% carbon, less than 3% aluminum, less than 0.010% nitrogen, less than 1% manganese, less than 0.01% sulfur and balance essentially iron.

11. The method of claim 1 wherein said heating method is selected from the group consisting of resistance heating, induction heating and direct energy heating.

12. A method for annealing cold rolled nonoriented electrical steel strip which comprises:

a. heating said strip at a rate above 133° per second, and b. heating said strip to a peak temperature of from 750° C. to 1150° C.

13. The method of claim 12 wherein said annealing is a decarburizing anneal and said peak temperature during decarburizing is from 800° C. to 900° C.

* * * * *